US011760461B2

(12) United States Patent
Schatz

(10) Patent No.: US 11,760,461 B2
(45) Date of Patent: Sep. 19, 2023

(54) WATERCRAFT WITH ELECTRIC PROPULSION SYSTEM

(71) Applicant: Kurt Matthew Schatz, Aurora (CA)

(72) Inventor: Kurt Matthew Schatz, Aurora (CA)

(73) Assignee: STROMM INDUSTRIES INC., Aurora (CA)

( * ) Notice: Subject to any disclaimer, the term of this patent is extended or adjusted under 35 U.S.C. 154(b) by 55 days.

(21) Appl. No.: 17/165,181

(22) Filed: Feb. 2, 2021

(65) Prior Publication Data

US 2022/0242544 A1 Aug. 4, 2022

(51) Int. Cl.

| | |
|---|---|
| ***B63H 25/42*** | (2006.01) |
| ***B63H 5/125*** | (2006.01) |
| ***B63H 5/08*** | (2006.01) |

(52) U.S. Cl.

CPC ..... *B63H 25/42* (2013.01); *B63H 5/08* (2013.01); *B63H 5/125* (2013.01)

(58) Field of Classification Search

CPC ..... B63H 25/42; B63H 5/08; B63H 5/125; B63H 21/17; B63H 23/24; B63H 2005/1258; B63H 5/1252

See application file for complete search history.

(56) References Cited

U.S. PATENT DOCUMENTS

| | | | | |
|---|---|---|---|---|
| 4,757,777 | A * | 7/1988 | Rosenberger | B63H 9/061 114/102.32 |
| 6,482,057 | B1 * | 11/2002 | Schoell | B63H 5/16 440/63 |
| 9,611,009 | B1 * | 4/2017 | Myers | B63H 25/38 |
| 10,331,137 | B2 * | 6/2019 | Miller | B63H 5/08 |
| 10,625,834 | B2 * | 4/2020 | MacFarlane | B63H 5/07 |

* cited by examiner

*Primary Examiner* — Anthony D Wiest
(74) *Attorney, Agent, or Firm* — Aird & McBurney LP

(57) ABSTRACT

An electric marine propulsion system including steering and vertical position control is provided. The electric drive assembly includes a main drive motor transmitting torque through a shaft to a propeller. The electric drive assembly integrates a dual rudder system positioned ahead of the main drive propeller. The rudder assemblies integrate electric stern thrusters for low-speed maneuvering. The steering and vertical position adjustments for the drive assembly are electrically operated. The electric drive assembly is installed entirely outside the hull of the watercraft.

23 Claims, 17 Drawing Sheets

Water Flow During While Boat is on Plane – Main Drive Powered On

Water Flow During Hybrid Operation – Rudder Thrusters and Main Drive Powered On

WATERCRAFT WITH ELECTRIC PROPULSION SYSTEM

FIELD

The present disclosure relates to a watercraft, and in particular a watercraft having electric propulsion and steering systems.

BACKGROUND

Watercraft, such as motor boats, are typically powered by gasoline or diesel motors, which consume liquid fuel to drive a propeller submersed in water. Smaller craft typically include a motor positioned outside of the hull which is connected by a transmission system to a propeller that is submersible. Such a propulsion system is operated as a single unit where both a rudder system and the propeller are moveable as a unit itself for controlling the steering of the vessel. Further more, the motor itself is moveable along with the skeg and propeller.

Larger boats may use an inboard/outboard type propulsion system where the motor is positioned inside the hull of the watercraft. The motor is in fixed position relative to the watercraft hull. Power is transmitted to an outdrive transmission by a shaft extending through an aperture in the hull. The outdrive transmission transfers power to the propeller through a geared assembly. Steering control is provided by rotating the entire outdrive assembly, which may not provide effective steering control during low-speed manoeuvres.

Still, some vessels combine the rudder system with the thrust vectoring ability such that movement of the propeller at angles towards starboard or port sides also corresponds with an angling of the rudder system. However, one drawback is that low-speed steering operation of such systems may be insufficient for desired maneuvering performance.

Such gasoline powered motor vessels are easy to refuel, in manners like automobiles. While fuel efficiency is a consideration for reducing the fuel consumption and saving fuel costs, advances have been made in watercraft technology. One such advancement includes operating the propeller as a surface drive propulsion system, where the only part of the propeller is submersed during high-speed operation for improving efficiency of the system.

While efficiency in operation of the gasoline motor is improved, however, drawbacks still remain associated with using a combustion-based engine, which not only effects air quality, but also water quality when such gasoline motors are used in watercraft, which may occur as a result of fuel leaks, oil leaks, and un-corn busted material being emitted directly into the water, which particularly increases for higher performance watercraft with high horsepower output.

In view of the above, it would be beneficial to provide technology that addresses and overcomes these issues so as to facilitate the design and manufacture of a watercraft propulsion system that provides enhanced performance and handling characteristics over the entire range of operation of the water craft, both at high-speed and at low-speed operation.

SUMMARY

This section provides a general summary of the disclosure, and is not a comprehensive disclosure of its full scope or all of its features.

According to one aspect of the present disclosure, there is provided a water craft having an electric motor propulsion system.

In a related aspect, the electric motor propulsion system includes an independently controllable thruster system and steering system.

In a related aspect, the thruster propeller system is a surface drive propulsion system whereby the propeller is operable at least partially submersed during operation.

In a related aspect, the main drive propeller is moveable only in the vertical plane, and is not moveable in the horizontal plane.

In a related aspect, the propeller extends from the stern of the watercraft so as not to be viewable when viewing from the bow of the watercraft In a related aspect, a drag-reducing cowling is positioned below the main drive and fixed to the rear transom plate.

In a related aspect, the propeller is positioned away from the stern of the watercraft, away from the steering system, such that the wake of the propeller does not disrupt a water flow around the rudder of the steering system.

In a related aspect the rudder of the steering system is positioned to receive laminar water flow conditioned by the hull of the watercraft.

In a related aspect the rudder of the steering system is positioned so that the water flow disturbance created by the rudder during forward operation of the watercraft does not affect the laminar flow of water reaching the main drive propeller.

In a related aspect the rudder of the steering system includes a thrust system directionally moveable in response to movement of the rudder.

In a related aspect the rudder of the steering system includes a hydrofoil for receiving there over the laminar water flow conditioned by the hull.

In a related aspect the electric propulsion system is positioned on the exterior of the hull of the watercraft.

In a related aspect the electric propulsion system includes a power/battery system positioned on the interior of the hull.

In a related aspect the power system includes a network of battery packs distributed throughout the hull.

In a related aspect the distribution of the battery packs throughout the hull acts to balance the weight of the watercraft towards the bow of the hull so as to counteract the weight of the propulsion system mounted to the stern of the watercraft.

In a related aspect the power system includes a plurality of battery packs distributed throughout the hull, where the majority of power units are placed to the bow of the watercraft.

In a related aspect the power system includes a plurality of battery packs distributed throughout the hull, where the power units are placed on symmetrically opposite sides of the longitudinal axis of the watercraft.

In a related aspect the electric motor propulsion system includes an electric motor sealed within a housing, where the housing is submersible in the water.

In a related aspect the housing of the electric motor propulsion system is moveable only in a vertical direction by operation of a linear actuator mounted to the hull of the water craft and the housing of the electric motor propulsion system.

In a related aspect the electric motor propulsion system includes an electric motor coupled to the propeller via an elongated shaft assembly for rotating the propeller.

In a related aspect the electric motor propulsion system includes an electric motor coupled to the propeller without a gear train, such that a direct drive of the propeller is provided.

In a related aspect the electric motor propulsion system includes an electric motor coupled to the propeller without a coupler, or joint within the shaft assembly.

In a related aspect the electric motor, the propeller, the housing, and the motor shaft are moveable together as a unit.

In a related aspect the housing houses a cooling system configured for removing heat from within the sealed housing generated by the electric motor, and transporting the heat to outside the housing.

In a related aspect the electric motor is vented into the hull interior through a flexible bellows.

In accordance with another aspect there is provided a water craft having a surface drive propulsion system and a lifting system configured to lift the propeller of the surface drive system at least partially out of the water during movement of the water craft.

According to another aspect of the present disclosure there is provided a watercraft having a hull extending between a stern and a bow along a longitudinal axis, a surface drive propeller system having a propeller attached to a shaft running along the longitudinal axis, and wherein the shaft is not moveable towards the port and starboard sides of the hull.

According to yet another aspect, there is provided a method of operating a watercraft including controlling a main surface drive motor moveable only in a vertical plane providing forward thrust to the water craft, and independently controlling a rudder system for controlling the direction of forward and rearward movement of the water craft.

According with yet another aspect, there is disclosed an electric marine surface drive propulsion system for a watercraft, such as a boat, the electric marine surface drive propulsion system consisting of an electric motor/shaft/propeller assembly mounted externally to the hull such that an axis of the propeller extends parallel to the water line during operation, a steering/rudder system located below the electric motor and forward of the propeller, the steering/rudder system consisting of one or two rudder blades for use as control surfaces. The rudder system is attached to and separately operable from the main electric propulsion system. The system further includes a complete motor/drive and steering/tilt system located externally to the hull. In a related aspect, the system includes a drive system which is allowed to pivot in the vertical plane only. In a related aspect, the rudder system is configured provide steering control. In a related aspect, the rudder system includes a rudder with an integrated hydrofoil for vertical lift during operation. In a related aspect, the rudder system includes one or more rudders with integrated motor/propeller for low-speed maneuvering. In a related aspect, the rudder system includes rudder(s) configured such that the propeller/propulsion is located to be out of the water when the boat is on plane to reduce drag. In a related aspect, the rudder(s)/propulsion components are separately electrically controllable from the main electric drive. In a related aspect, the rudder propulsion system is configured to operate in a counter-rotating direction, so that the starboard propulsion rotates in one direction (e.g. clockwise when viewed from rear), and the port propulsion rotates in the opposite direction (e.g. counter-clockwise when viewed from the rear).

In accordance with another aspect, there is provided an electrical propulsion system for a motor boat having a throttle control system configured for operating in a low-speed mode, high-speed mode, and a hybrid mode, such that when operating in a low-speed mode, the throttle control system controls an electric motor configured for rotating a propeller associated with steering and providing thrust to the watercraft without operating the main drive propeller associated with providing a forward thrust to the watercraft, and such that when operating in a high-speed mode, the throttle control system controls an electric motor configured for rotating a main drive propeller associated with propelling the watercraft without operating a propeller associated with providing a steering thrust for thrusting to the watercraft in starboard and port directions. In a related aspect, the hybrid mode of operation operates a propeller connected to the rudder, and also operates the main drive propeller. In a related aspect, the throttle control system is configured to operate both an electric motor associated with providing forward only thrust to the watercraft, and operating an electric motor associated with providing port and starboard directed thrust to the watercraft.

These and other aspects and areas of applicability will become apparent from the description provided herein. The description and specific examples in this summary are solely intended for purpose of illustration and are not intended to limit the scope of the present disclosure. The drawings that accompany the detailed description are described below.

BRIEF DESCRIPTION OF THE DRAWINGS

The drawings described herein are for illustrative purposes only of selected non-limiting embodiments and not all possible or anticipated implementations thereof, and are not intended to limit the scope of the present disclosure.

DETAILED DESCRIPTION OF EXAMPLE EMBODIMENTS

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail.

Figure 1A:
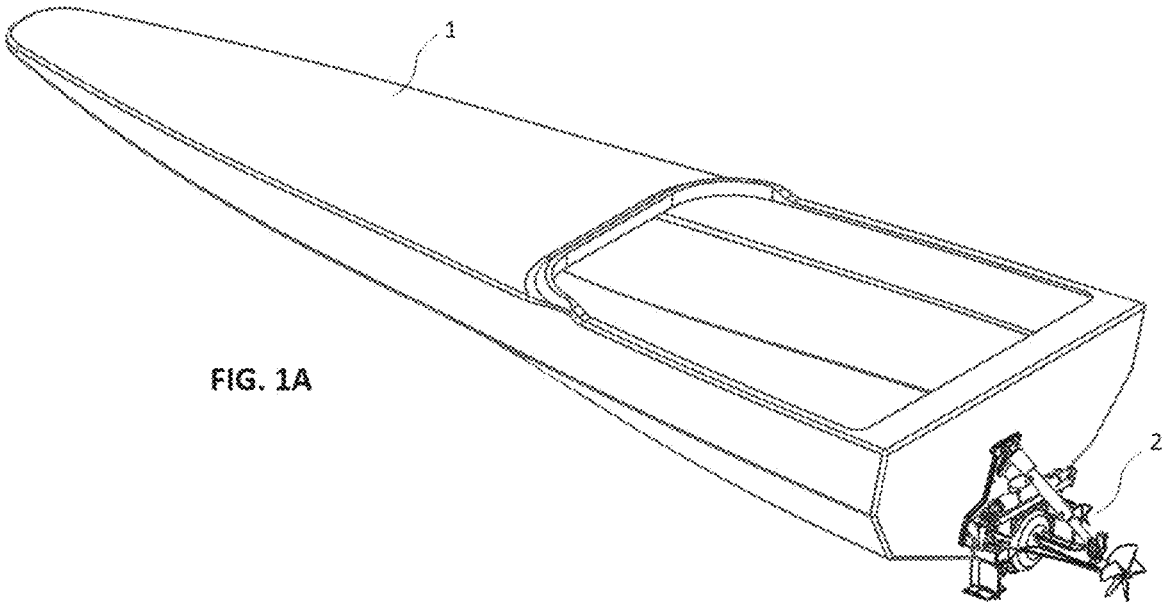
FIG. 1A is a rear perspective view and illustrates a watercraft with an electric propulsion system.
Figure 1B:
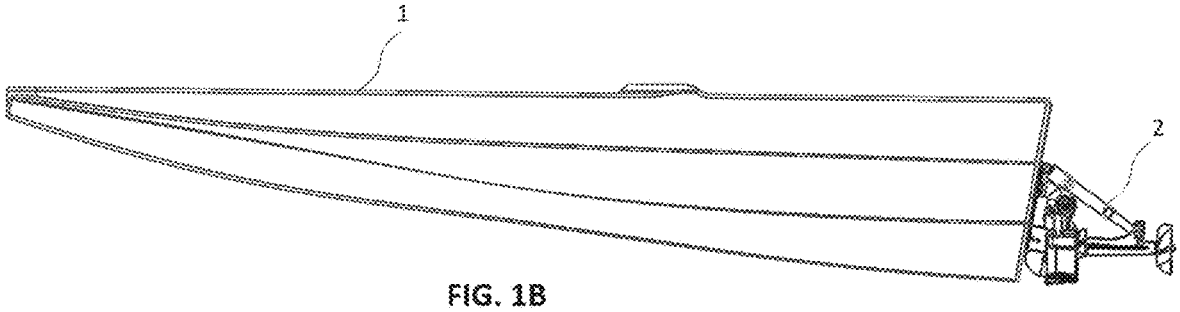
FIG. 1B is a side view and illustrates a watercraft with an electric propulsion system.

As best shown in FIGS. 1A AND 1B, the present disclosure describes an electric surface drive propulsion system 2 mounted completely externally to a watercraft 1. The propulsion system is fixed to the watercraft by means of bolts or other mechanical fasteners. The propulsion system is attached to the transom by means of a transom mounting plate 3. The main drive unit 7 and the linear mechanical actuator 5 are attached to the transom mounting plate 3.

Figure 2:
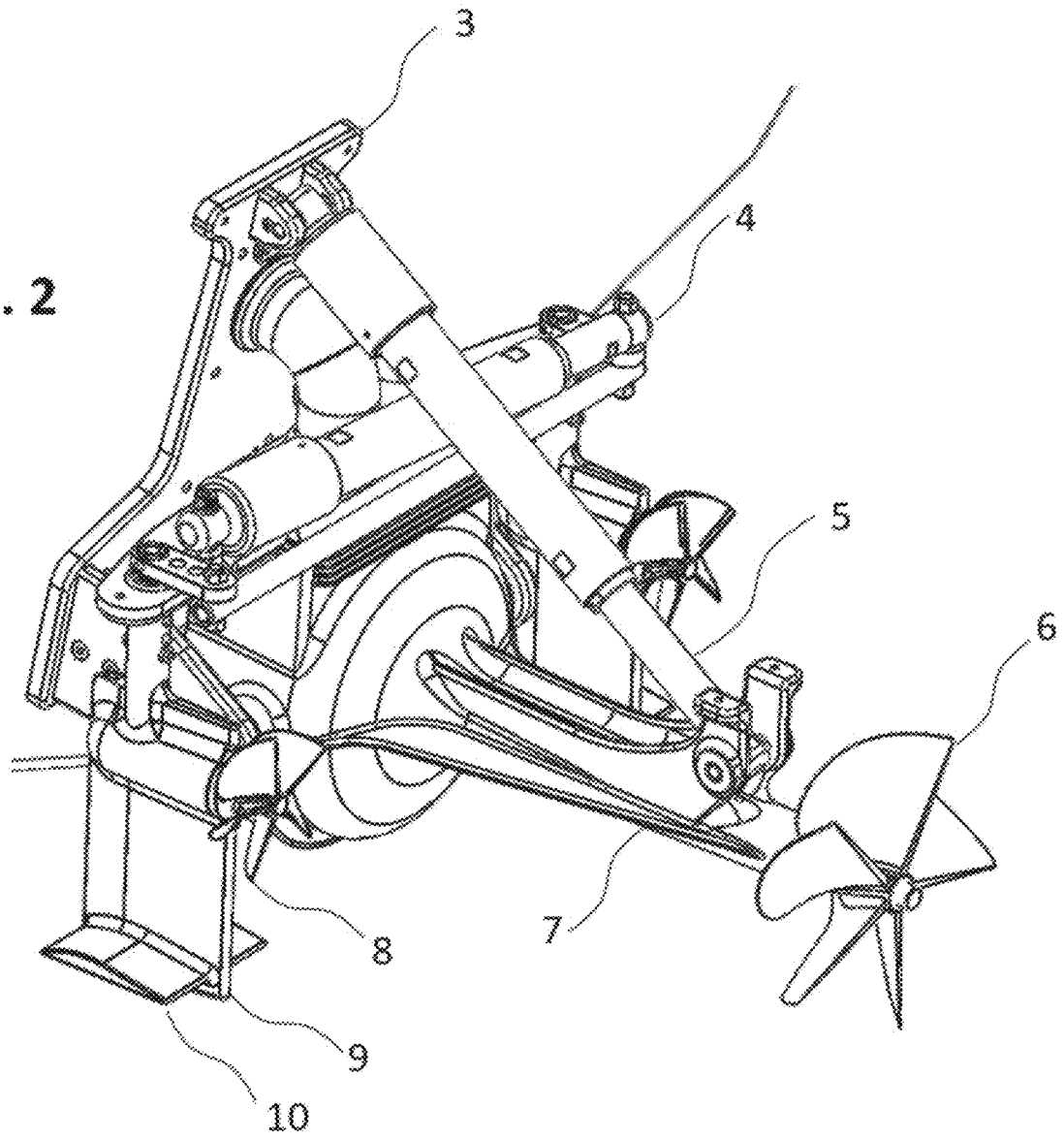
FIG. 2 is a rear perspective view and illustrates an electric propulsion system installed on a watercraft.

As shown in FIG. 2, the propulsion system is connected to the transom by means of a transom mounting plate assembly 3. The main drive unit 7 and the linear mechanical actuator 5 are connected to the transom mounting plate assembly 3. The propulsion system integrates the linear electric mechanical actuator 5 used for controlling the vertical orientation of the main drive unit 7. The propulsion system integrates the linear electric mechanical actuator 4 used for controlling the rudder(s) 9 orientation relative to the watercraft. The electric linear actuators 4 and 5 eliminate the need for a hydraulic actuator control system as used in some systems. By this electric actuator method, complexity, weight and maintenance requirements are reduced over a hydraulic system. The moveable rudder(s) 9 are mounted to the main drive assembly 7 and change their vertical orientation as the vertical orientation of the main drive unit is changed. In this way, the lifting hydrofoil(s) 10 remains parallel to the main drive unit shaft axis. Since the main shaft/prop axis surface drive propulsion system is typically operating parallel to the water's surface, the lifting hydrofoil also operates parallel to the water's surface. By this method, the lifting hydrofoil(s) 10 provides an upward force to the transom during forward operation. Since the surface drive propulsion system does not provide lift force to the watercraft during forward operation, the lifting hydrofoil(s) 10 are incorporated so the operator of the watercraft can vary the orientation of the hull with respect to the water's surface during forward operation by changing the vertical orientation of the main drive unit 7. The main drive unit 7 can be angularly adjusted in vertical orientation only through the activation of the non-back driveable linear mechanical actuator 5, and steering control is accomplished through the separately-operable rudder(s) 9 assemblies. The rudder(s) 9 assemblies integrate a low-speed propulsion system 8 into the rudder casting 9. The rudder 9 is cast from an aluminum alloy such as 5083. Surface drive propulsion systems are inherently difficult to control during low-speed manoeuvring due to the extended distance between the propeller and the transom. By integrating the low-speed propulsion system 8 into the rudder 9 assembly, the propulsion unit is optimized for low-speed docking and trolling operations. The low-speed 8 and high-speed 7 propulsion systems are separately operable from each other through the control system as described in FIG. 9 and FIG. 10. The terms "high-speed" and "low-speed" used herein in distinguishing between the propulsion systems 7, 8, respectively, and their constituent parts may alternatively be denoted herein by the terms "main" and "auxiliary", respectively.

Figure 3:
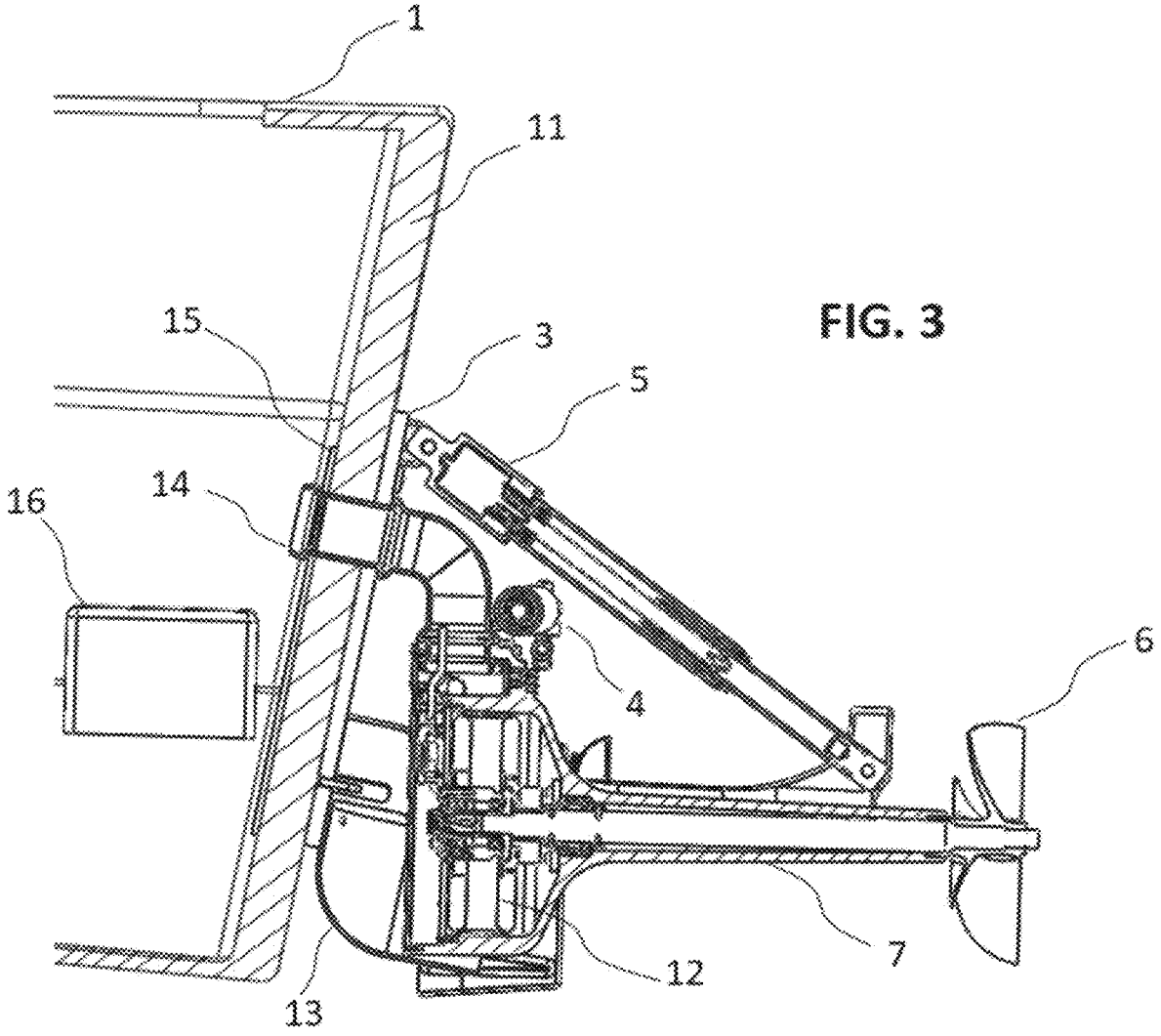
FIG. 3 is a vertical section view through the centerline of a watercraft and illustrates an electric propulsion system installed on a watercraft.

As shown in FIG. 3, the main drive unit 7 and associated steering 4 and vertical orientation 5 actuators are located externally to the hull. This method optimizes the usable floor space inside the watercraft, since no motor is required internally to the watercraft hull. This method also reduces the noise perceptible to the watercraft operators. The transom 11 of the watercraft 1 is used for structural attachment of the propulsion system 2. A distributed battery pack system 16 is installed internally to the watercraft hull to provide power to the all-electric drive and control system. An electric motor 12 is used to rotate the main drive propeller 6. No gear reduction is designed into this system in order to optimize performance. The main drive electric motor operates from 0 RPM to approximately 4000 RPM, which is ideal for most watercraft applications. Since an externally-mounted drive system is relatively large and produces unwanted drag during forward operation, a drag-reducing cowling 13 is described. The drag-reducing cowling 13 is geometrically designed to reduce hydrodynamic drag, and may be injection-molded from a polymer such as PC-ABS. The drag-reducing cowling 13 is coated with a drag-reducing hydrophobic coating to reduce frictional drag during forward operation of the watercraft. The drag-reducing cowling 13 remains fixed to the external transom mounting plate assembly 3. The main drive unit 7 is vertically adjustable. By this method, the leading surface of the main drive unit 7 remains out of the water flow during forward motion, and therefore drag is reduced. A flexible EPDM rubber bellows 14 is used to provide a waterproof path for power and signal wires between the internal hull electronic modules and battery packs 16 and the externally-mounted propulsion system. The main drive motor 12 must be vented to atmosphere for optimal operation, so the rubber bellows 14 additionally provides a venting path between the main drive motor 12 housing and the internal transom dry side 15. Venting the main drive motor 12 to the internal dry side 15 of the transom is the optimal venting method since it reduces the risk of water ingress to the main drive motor 12

Figure 4:
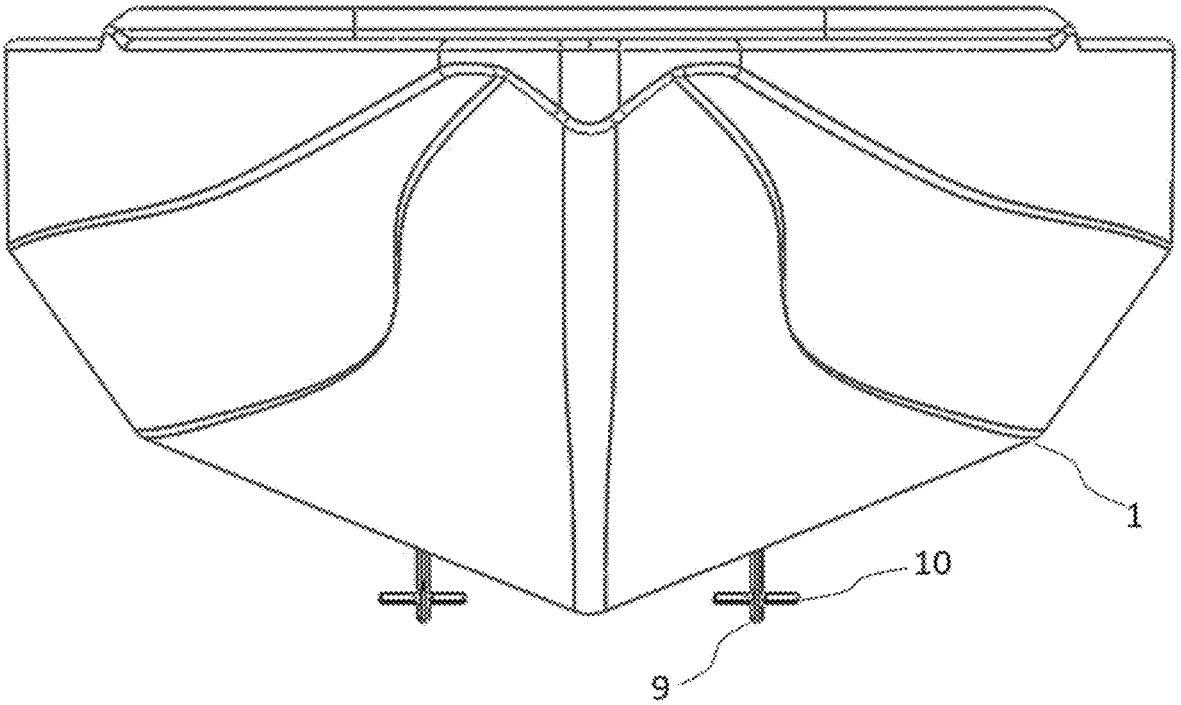
FIG. 4 is a front view of a watercraft and illustrates the spatial relationship of the rudders and hydrofoils to the hull of the watercraft.

As shown in FIG. 4, the rudder(s) 9 and the lifting hydrofoil(s) 10 are designed to protrude below the bottom of the hull of the watercraft 1. This method provides for minimized drag during forward operation, since the main drive unit 7 is shielded by the hull of the watercraft 1.

Figure 5:
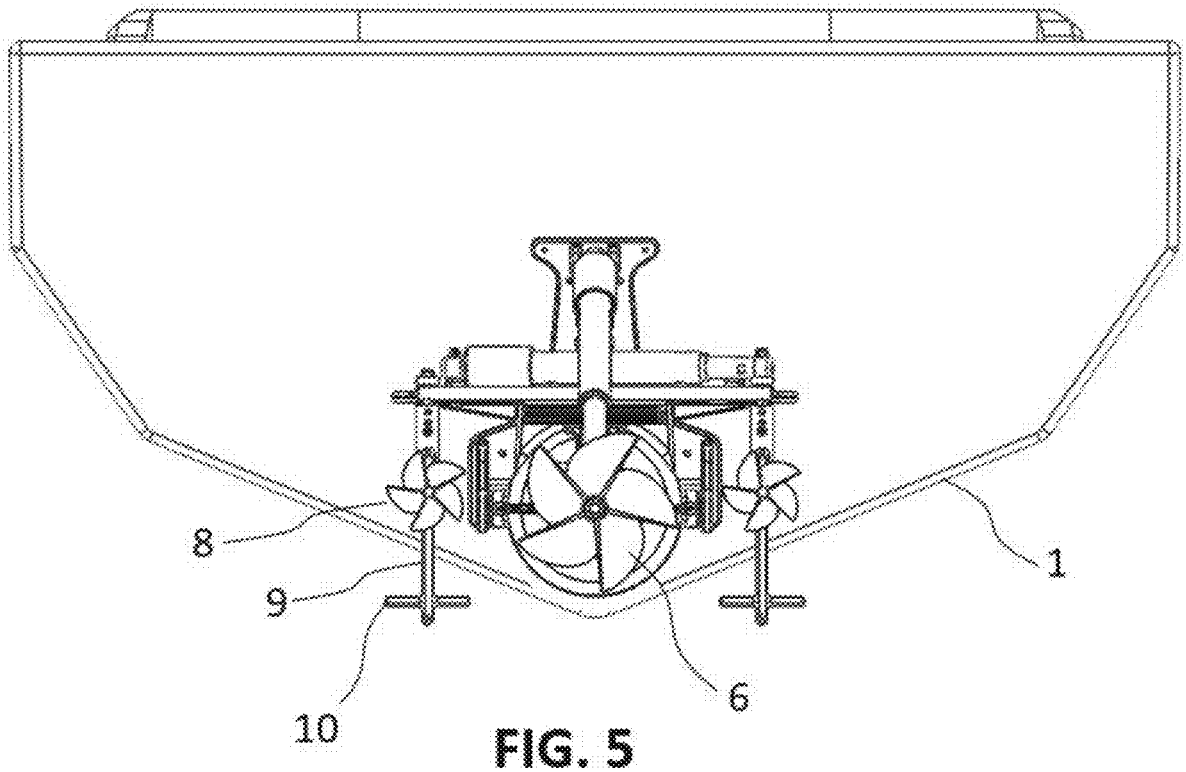
FIG. 5 is a rear view of a watercraft with an electric propulsion system and illustrates the spatial relationship of the rudder propulsion systems to the main drive propulsion and the hull of the watercraft.

As shown in FIG. 5, the main drive propeller 6 is located on center of the watercraft 1, and vertically located to optimize the propeller location relative to the water's surface during forward high-speed motion. In a surface drive propulsion system, the propeller is designed to be only partially submerged during forward operation in order to increase propeller efficiency by reducing the effects of cavitation. The low-speed propulsion system(s) 8 is offset vertically and horizontally from the main drive propeller 6. In using this offset method, the turbulence created by the rudder(s) 9 and the low-speed propeller(s) 8 does not affect the laminar water flow reaching the main drive propeller 6. Therefore, main drive propeller performance is optimized.

Figure 6:
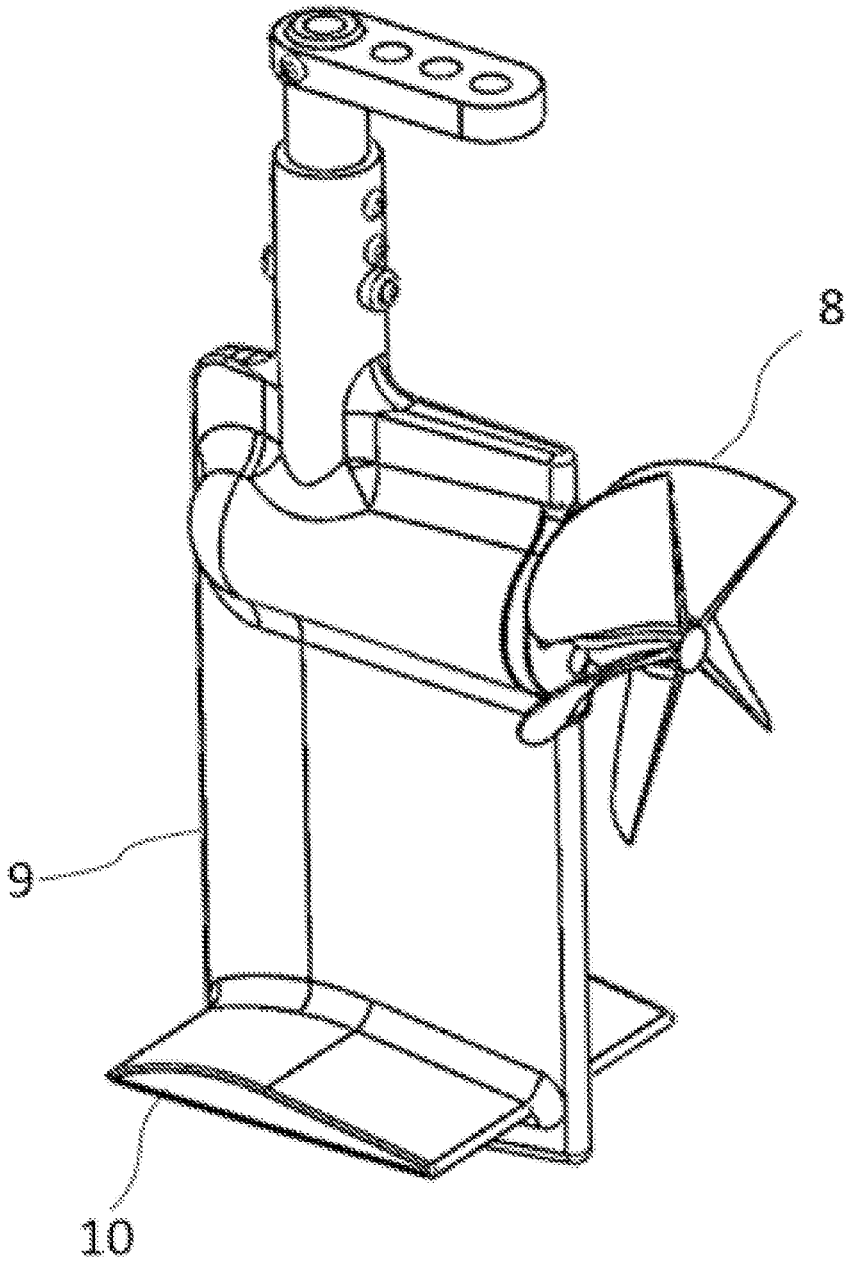
FIG. 6 is a rear perspective view of a rudder assembly illustrating an integrated electric propulsion system and hydrofoil features.

As shown in FIG. 6, a rudder 9 assembly integrates a hydrofoil structure 10 and a low-speed electric propulsion system 8.

Figure 7A:
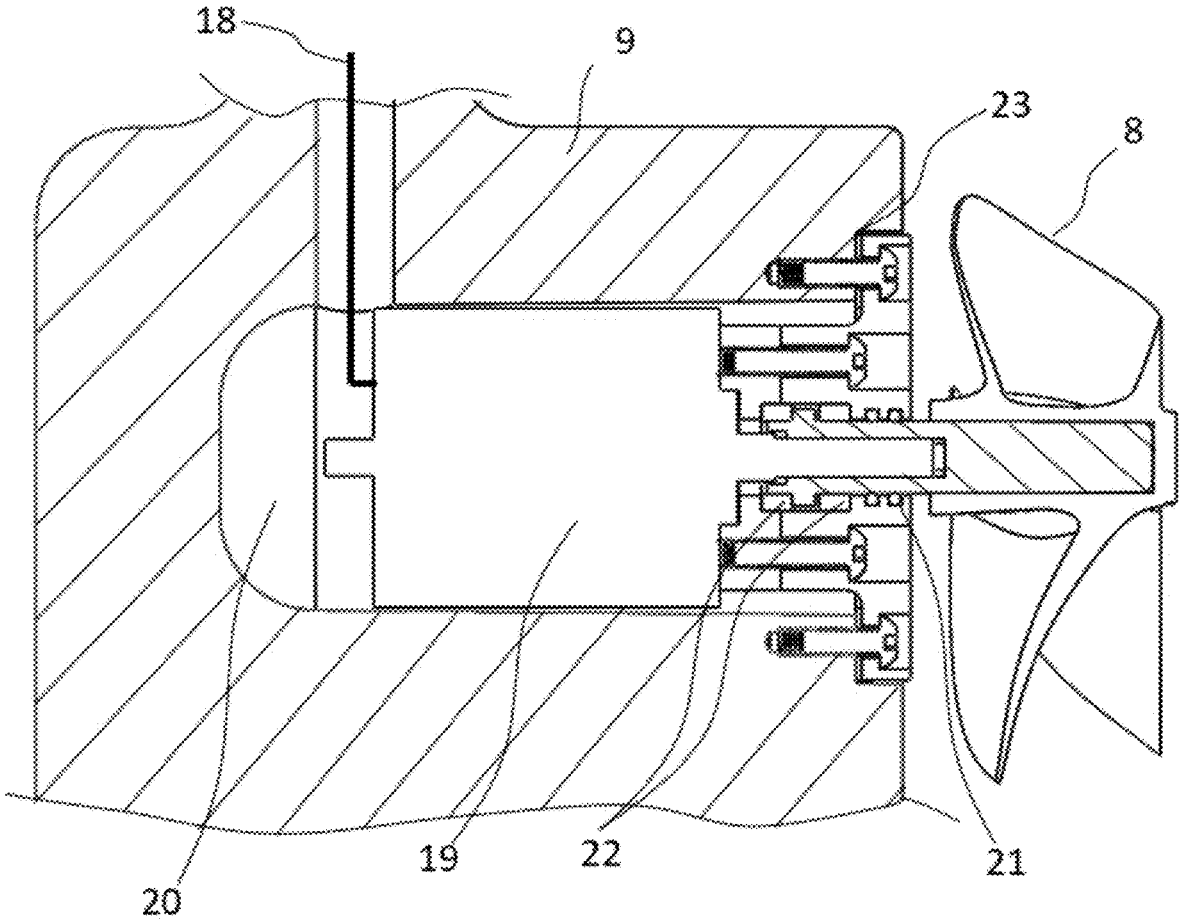
FIG. 7A is a vertical section view through the centerline of a rudder assembly illustrating an integrated electric propulsion system and water sealing features.
Figure 7B:
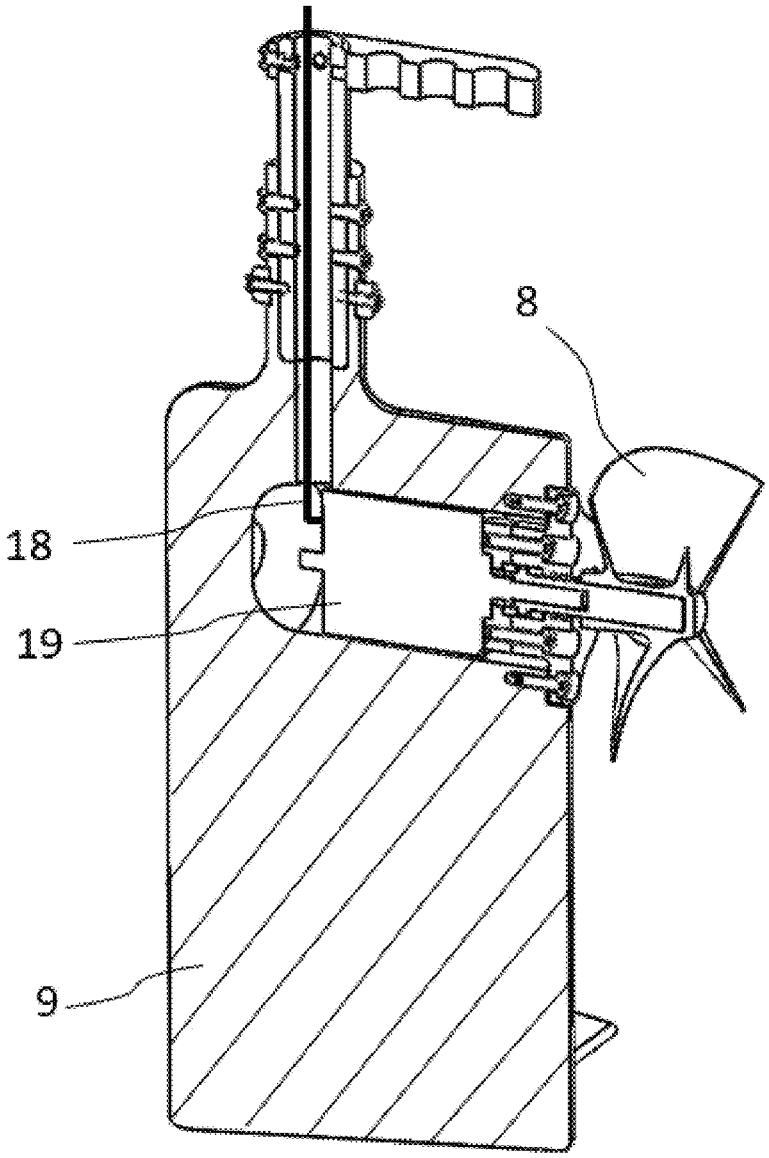
FIG. 7B is a vertical section view through the centerline of a rudder assembly illustrating an integrated electric propulsion system and water sealing features.

As shown in FIGS. 7A and 7B, the low-speed propulsion system integrated into the rudder 9 casting includes an electric motor 19, a thrust bushing assembly 22, a shaft sealing system 21, a cover sealing system 23, and a motor control and power wire harness 18. In other words, the integrated nature of the low-speed (auxiliary) propulsion system into the rudder 9 means that the low-speed (auxiliary) propulsion system is attached to the rudder 9 so as to move in unison with the rudder 9 relative to the watercraft 1. At assembly, the cavity 20 is encapsulated with a water sealing and thermally-conductive potting compound to prevent water ingress to the motor and provide heat transfer between the electric motor 19 and the aluminum rudder 9 casting.

Figure 8:
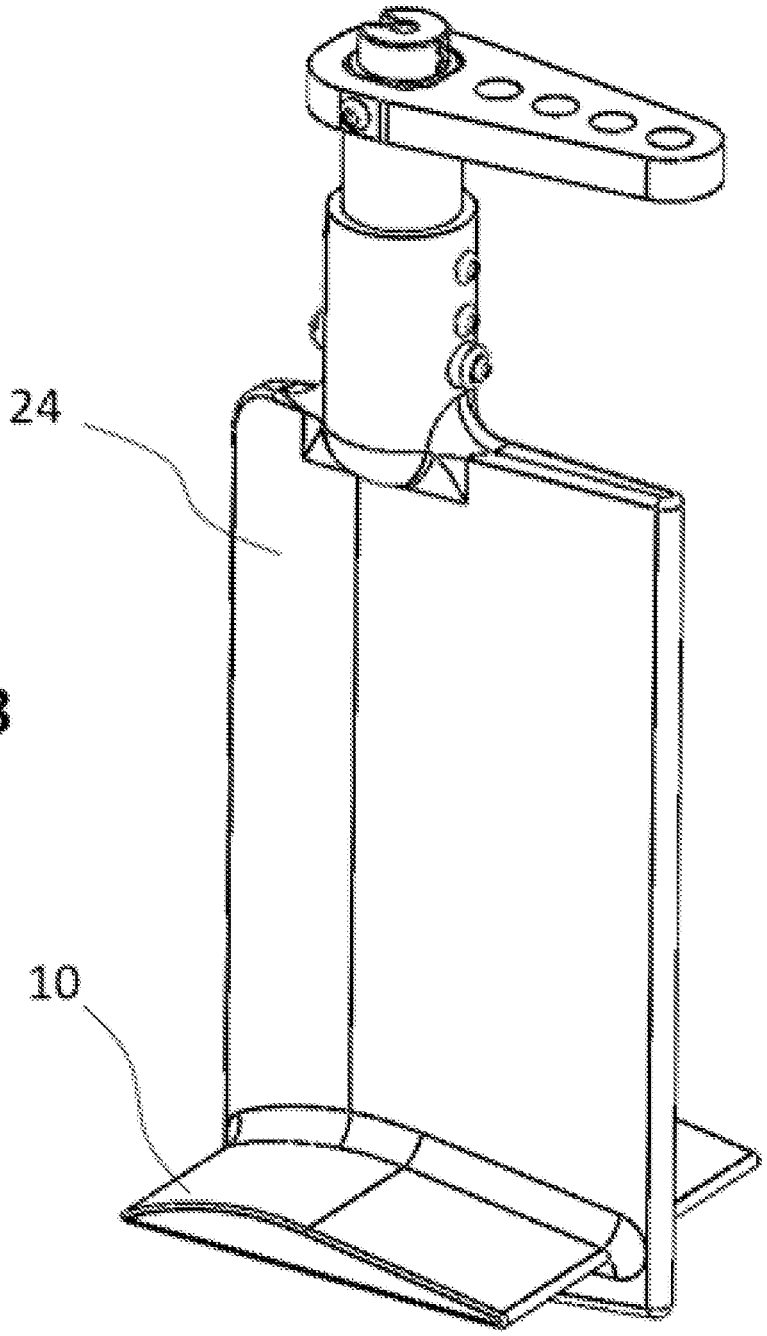
FIG. 8 is a rear perspective view through the centreline of a rudder assembly with integrated hydrofoil features.

As shown in FIG. 8, a rudder 24 assembly without integrating a low-speed electric propulsion system. This rudder assembly is ideal for high-performance applications such as racing boats since it minimizes drag by reducing the rudders cross-sectional area.

Figure 9:
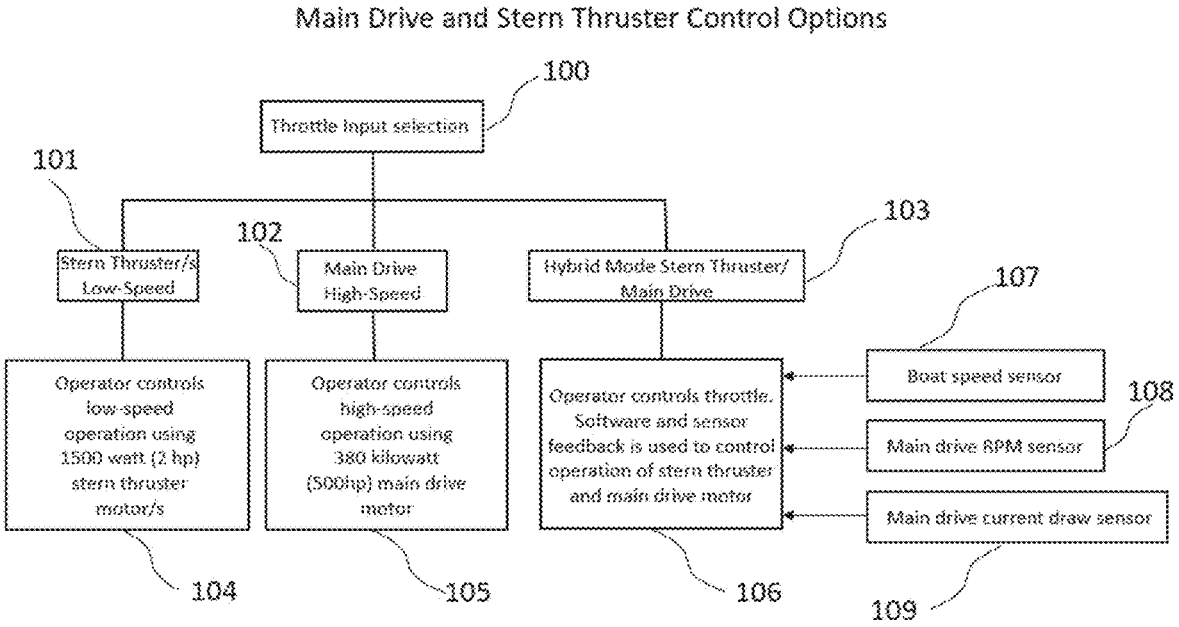
FIG. 9 is a schematic illustrating a method of operating an electric propulsion system of a watercraft in multiple modes according to aspects of this disclosure.

Shown in FIG. 9 is a method of operating a watercraft using three operator-selectable modes with the propulsion hardware as described in this disclosure. As shown by box 100, the operator of the watercraft can select from three modes of propulsion. Mode 101 involves supplying power to only the rudder 8 stern thruster(s). As shown by box 104, this mode may be used for low-speed docking operations, fishing operations such as trolling, and low-speed cruising for example. Mode 102 involves supplying power to only the main drive unit 7. As shown by box 105, this mode may be used for high-speed watercraft operation. Mode 103 involves pre-programmed software control of both the stern thruster(s) 8 and the main drive unit 7. Mode 103 is used for optimal performance during watercraft acceleration from rest, for example. As shown by box 106, during watercraft acceleration from rest, the stern thruster(s) 8 and the main drive unit 7 are powered on for maximum acceleration. Once the watercraft has accelerated and is on plane, the stern thruster(s) 8 are powered off through software control, thereby minimizing power consumption. Sensors 107, 108, and 109 are used to determine the watercraft real-time performance, and thereby provide feedback to the software control system.

Figure 10:
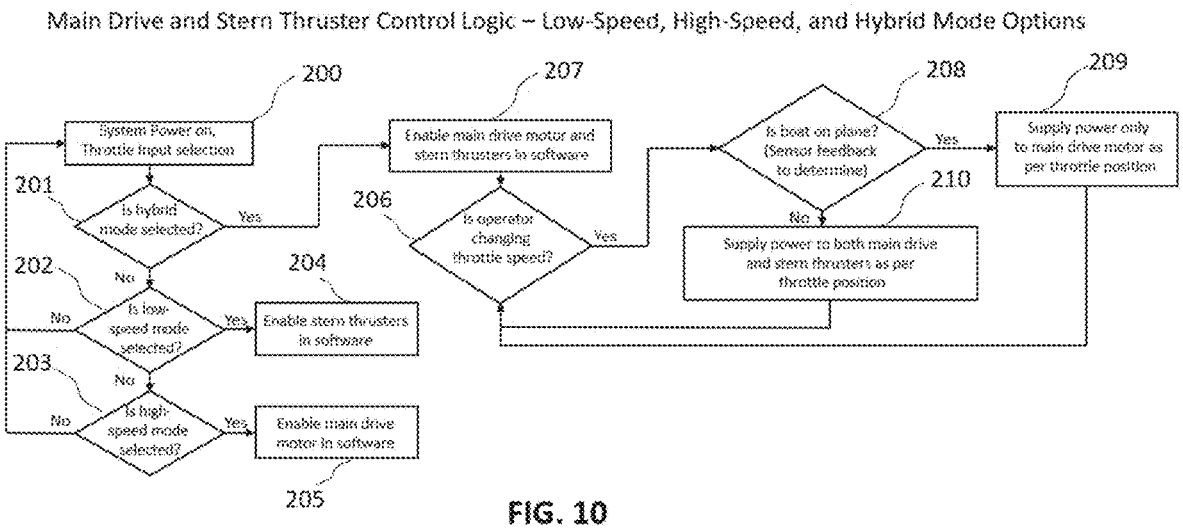
FIG. 10 is a flowchart illustrating steps of a method of operating an electric propulsion system of a watercraft in multiple propulsion modes according to aspects of this disclosure.

Shown in FIG. 10 is a logic flow chart describing the propulsion system response as a result of the drive mode selected. At step 200, the watercraft operator has the option of three selectable propulsion modes. Once the software system receives the desired selection from the watercraft operator, the selected propulsion mode is enabled as detailed. If at step 201, the software system determines that the hybrid mode is selected, then at step 207, the software system enables the drive motors and stern thrusters. If at step 206, the software system determines that the operator is changing throttle speed, and if at step 208 the software system determines the boat is on plane, then at step 209 the software system supplies power only to the main drive motor as per throttle position. If at step 208 the software system determines that the boat is not on plane, then at step 210 the software system supplies power to both the main drive motor and stern thrusters as per throttle position. If at step 202 the software system determines that the low-speed mode is selected, then at step 204 the software system enables the stern thrusters. If step 203 the software system determines that the high-speed mode is selected, then at step 205 the software system enables the main drive motor.

Figure 11A:
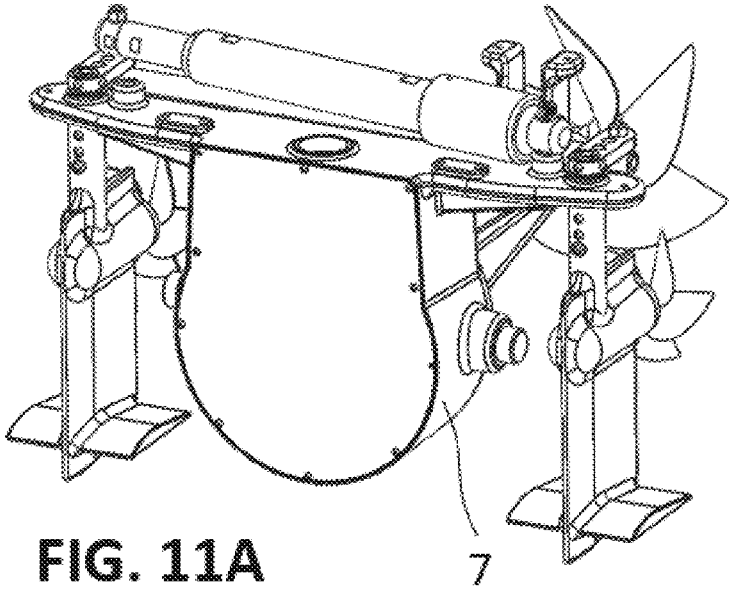
FIG. 11A is a front perspective view of an electric marine propulsion system.

Shown in FIG. 11A is the main drive unit assembly.

Figure 11B:
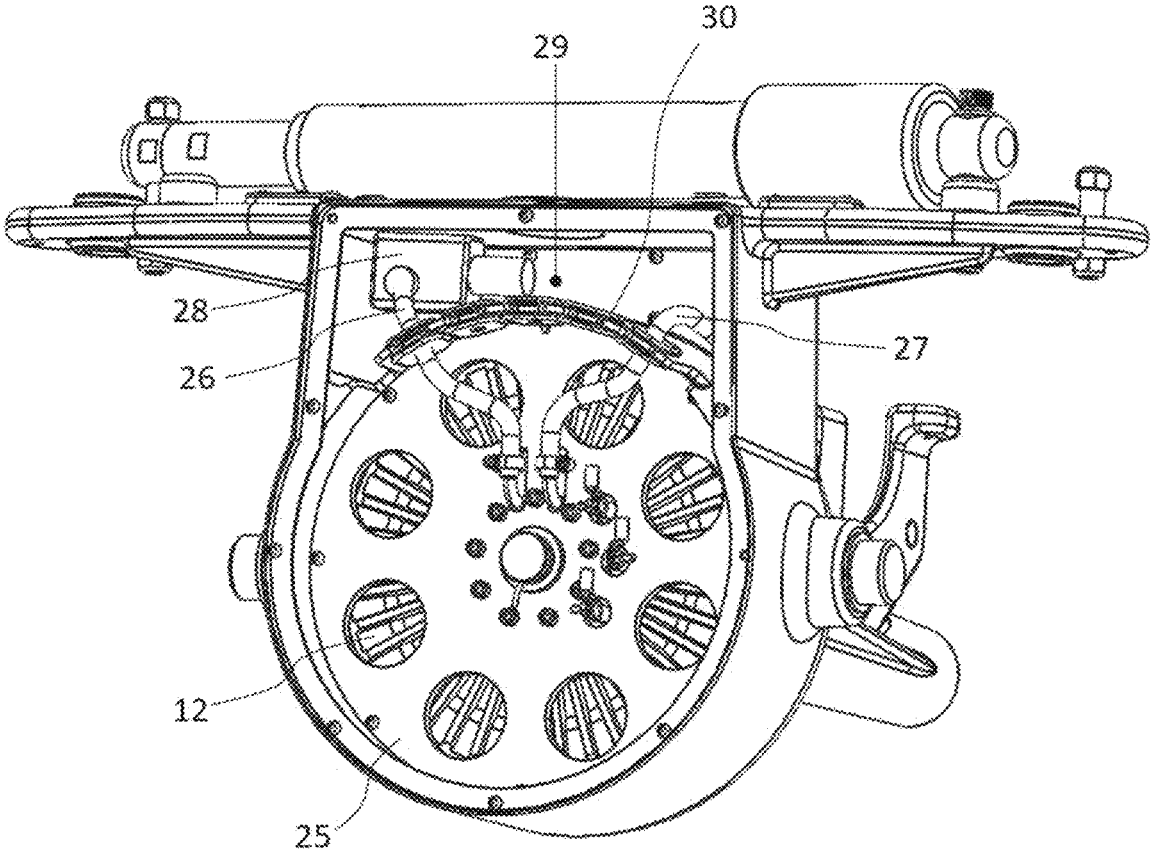
FIG. 11B is a front perspective view of an electric marine propulsion system illustrating the cooling system.

Shown in FIG. 11B is the internal motor and cooling system detail, since the front cover plate has been removed. The main drive motor 12 has an internal circuit for cooling fluid flow. The main drive motor 12 is fixed to the main casting through mounting plate 25. The cooling inlet hose 26 is attached the main drive motor 12 and the coolant pump 28. A hose 27 attaches the coolant pump 28 to a fitting on the covering plate 29.

Figure 12A:
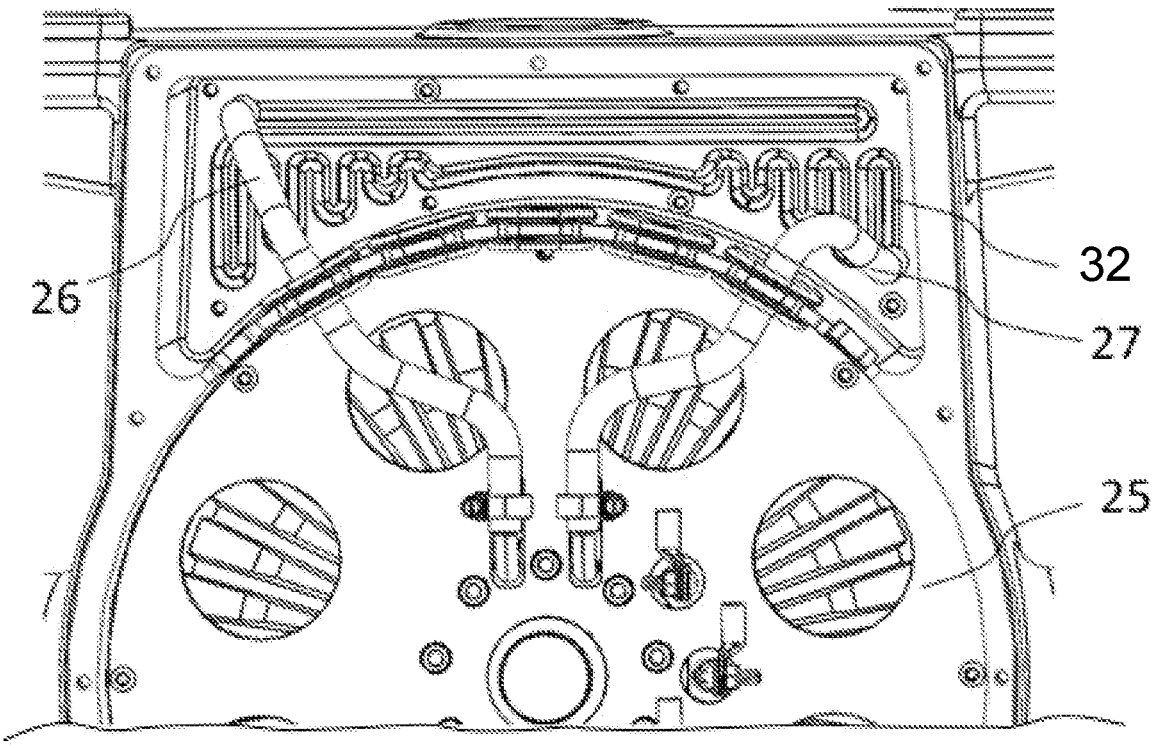
FIG. 12A is a front view of an electric marine propulsion system illustrating the cooling system channels.
Figure 12B:
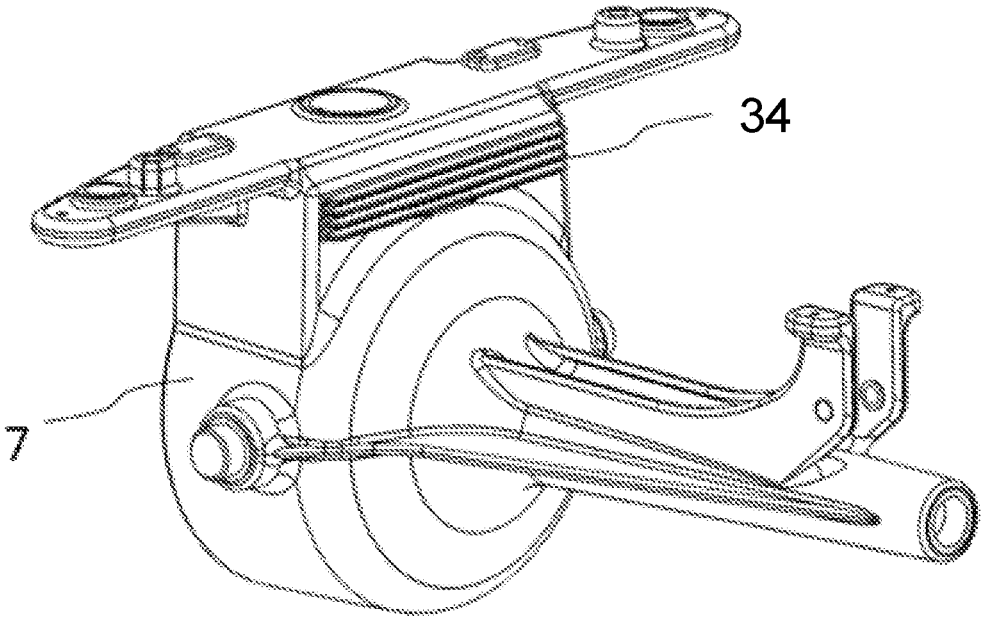
FIG. 12B is a rear perspective view of the main drive casting illustrating the external cooling surfaces.
Figure 12C:
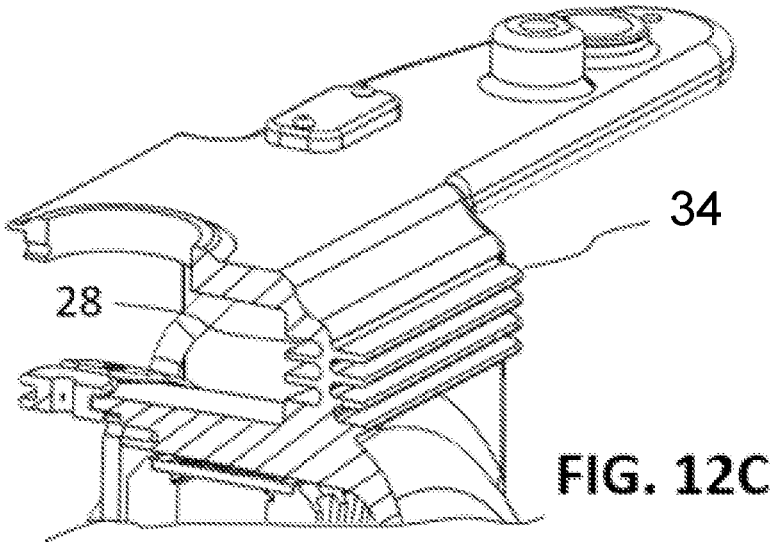
FIG. 12C is a rear perspective section view of the main drive casting illustrating the internal cooling channels and external cooling surfaces.

Shown in FIG. 12A are the cooling channels 32 integrated into the main drive aluminum casting. The coolant pump 28 is not shown for clarity. The coolant fluid is circulated through the main drive motor 12 cooling circuit and routed into the cooling channels 32. The cooling channels are sealed off using a covering plate 29 and gasket (not shown). Thermal energy is conducted from the fluid into the main drive casting 7, and exterior cooling fins 34 in FIG. 12B are designed to transfer the thermal energy to the external environment through convection and conduction to the water spray on the exterior surface of the main drive casting 7. FIG. 12C details the internal cooling channels and the external cooling fins. The main drive motor 12 thermal performance is optimized through using the main drive casting 7 as a thermal reservoir. At higher speeds the water spray on the main casting 7 provides conductive cooling to the exterior cooling fins 34. At low speed, the main drive unit 2 is largely submerged, provide optimal motor cooling through conduction of the aluminum main drive casting.

Figure 13:
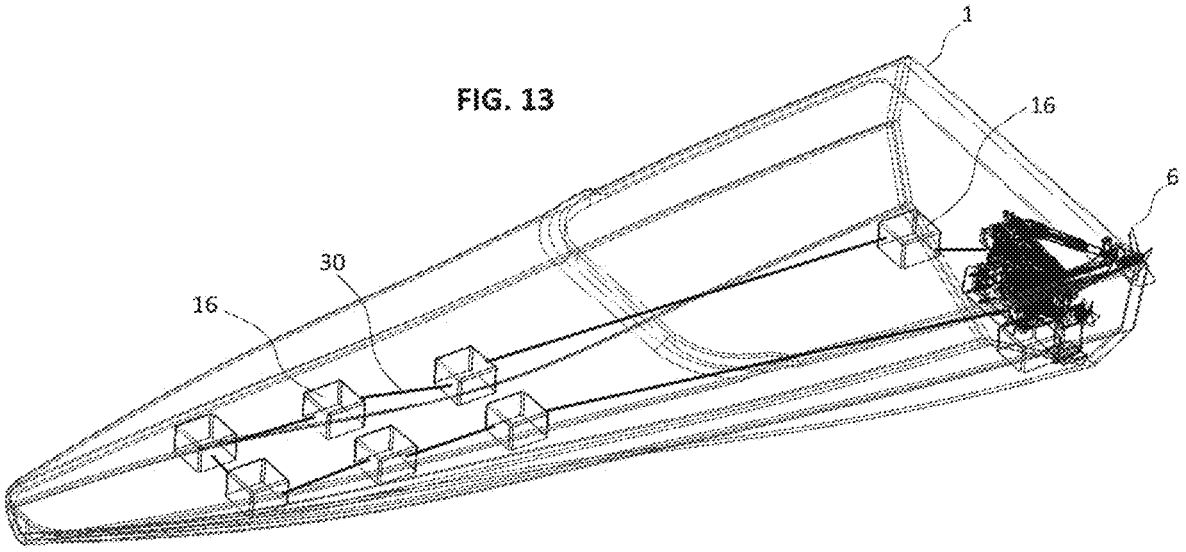
FIG. 13 is a front perspective view a watercraft illustrating a distributed battery pack system.

FIG. 13 shows a distributed battery pack system. One battery pack 16 is designed to be 436 volts, and 5 amp-hour. The battery packs are connected in parallel through a wiring harness 30 to provide additional battery capacity at 436 volts. The battery packs 16 are designed to be manually removed from the watercraft if necessary. During winterization, it is advantageous to remove the battery packs from the watercraft for storage if the watercraft is to be stored in cold temperatures. The distributed battery pack system allows for battery pack 16 removal for winterization or battery pack 16 replacement. Additionally, distributed battery packs allow for mass balancing inside the watercraft to optimize watercraft performance.

Figure 14A:
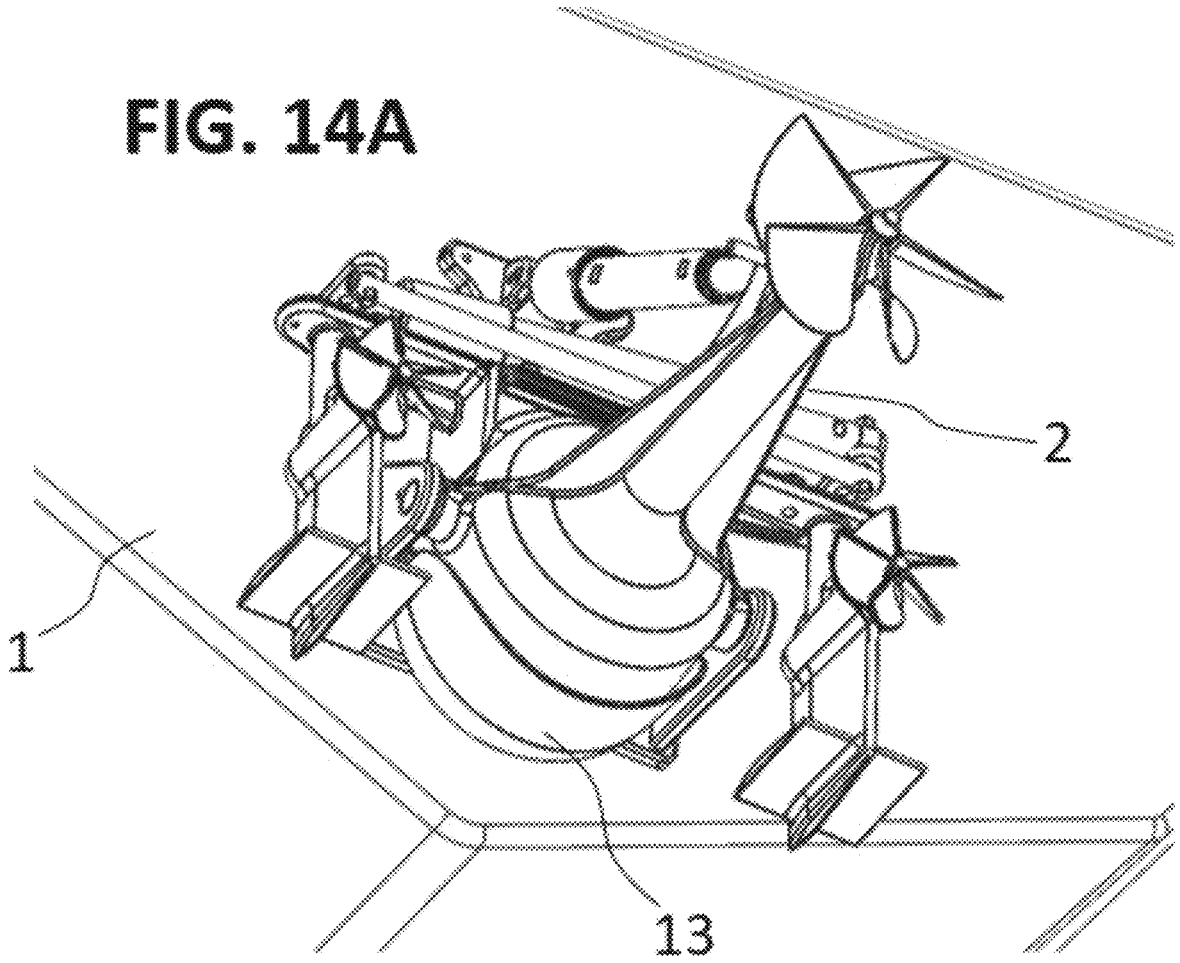
FIG. 14A is a rear perspective view of an electric propulsion system installed on a watercraft transom and illustrating a drag-reducing cowling
Figure 14B:
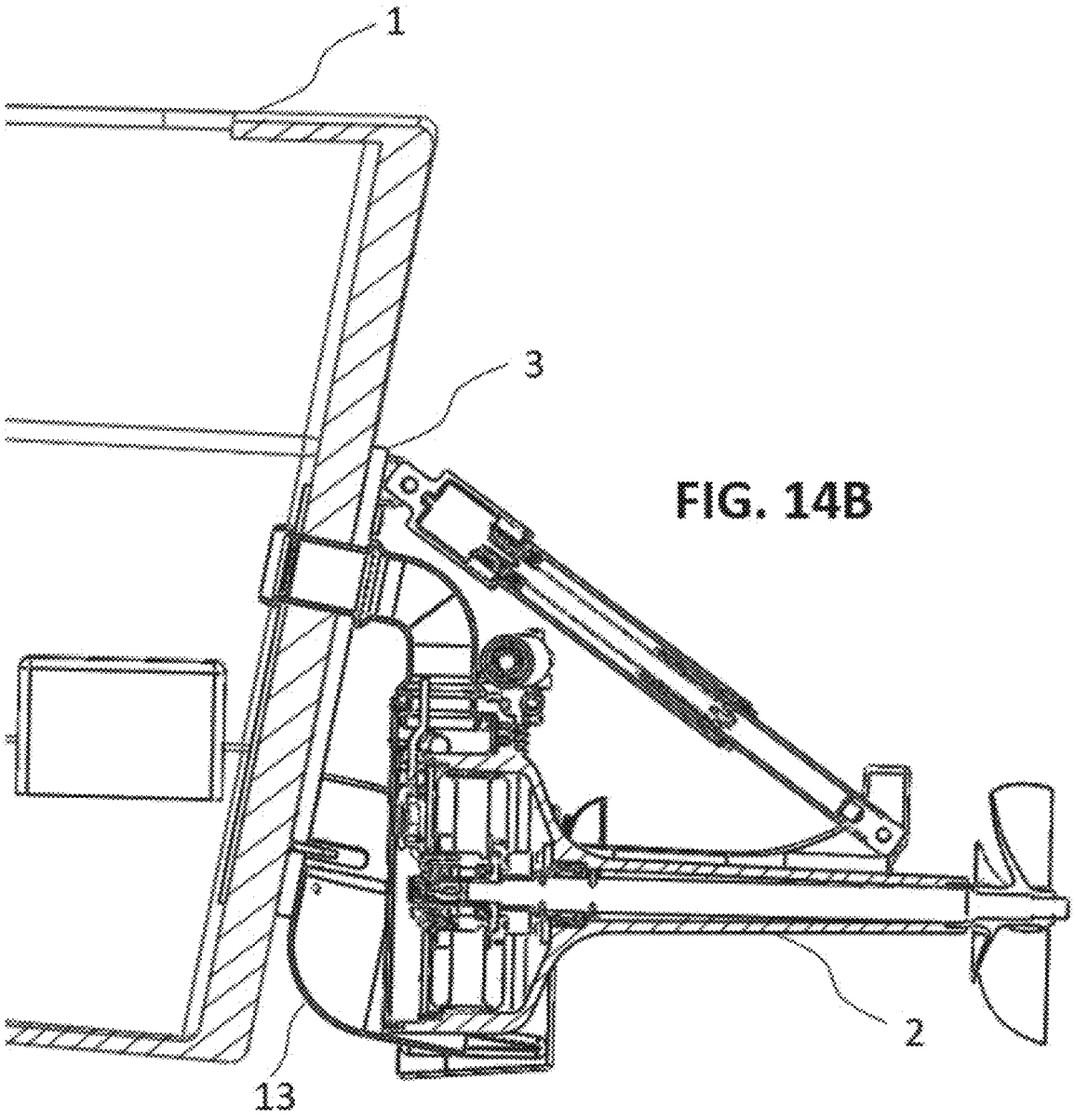
FIG. 14B is a vertical section view through the centerline of an electric propulsion system installed on a watercraft illustrating the relationship of the drag-reducing cowling to the hull and the electric propulsion system.

FIGS. 14A and 14B illustrate the drag-reducing cowling 13 fixed to the external transom mounting plate assembly 3. The drag-reducing cowling 13 minimizes drag caused by the main drive unit assembly 2 during forward motion of the watercraft. The drag-reducing cowling is manufactured from a low-friction polymer such as PC-ABS, and is coated with a hydrophobic coating to minimize drag.

Figure 15A:
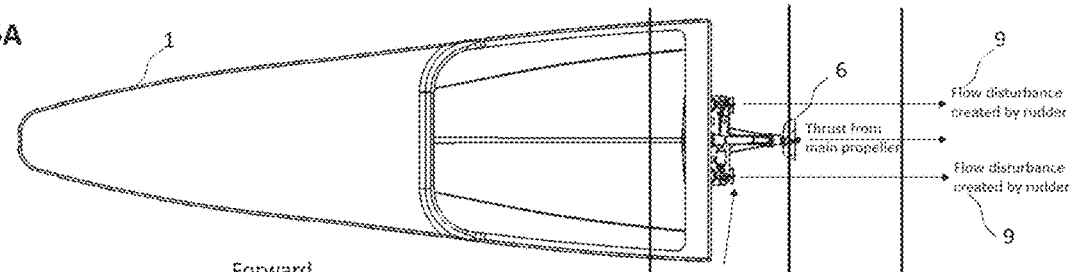
FIG. 15A is a top view of an electric propulsion system installed on a watercraft illustrating the water flow characteristics with respect to the rudders and main drive propeller.
Figure 15B:
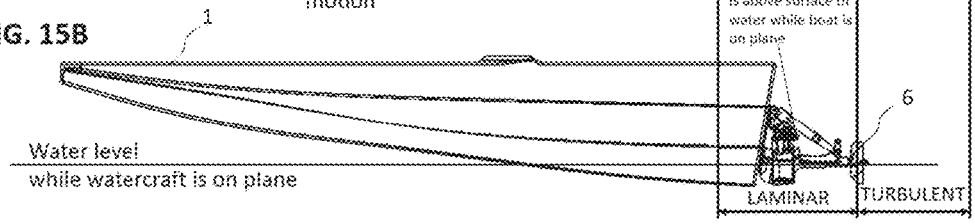
FIG. 15B is a side view of an electric propulsion system installed on a watercraft illustrating the water flow characteristics with respect to the rudders and main drive propeller.

FIGS. 15A and 15B show the water flow under the watercraft 1 during forward motion with the watercraft 1 on plane and only the main drive propeller 6 powered on. The flow disturbances created by the rudder(s) 9 will not affect the thrust performance of the main drive propeller 6 since the rudder(s) are offset from the centerline of the watercraft 1.

Figure 16A:
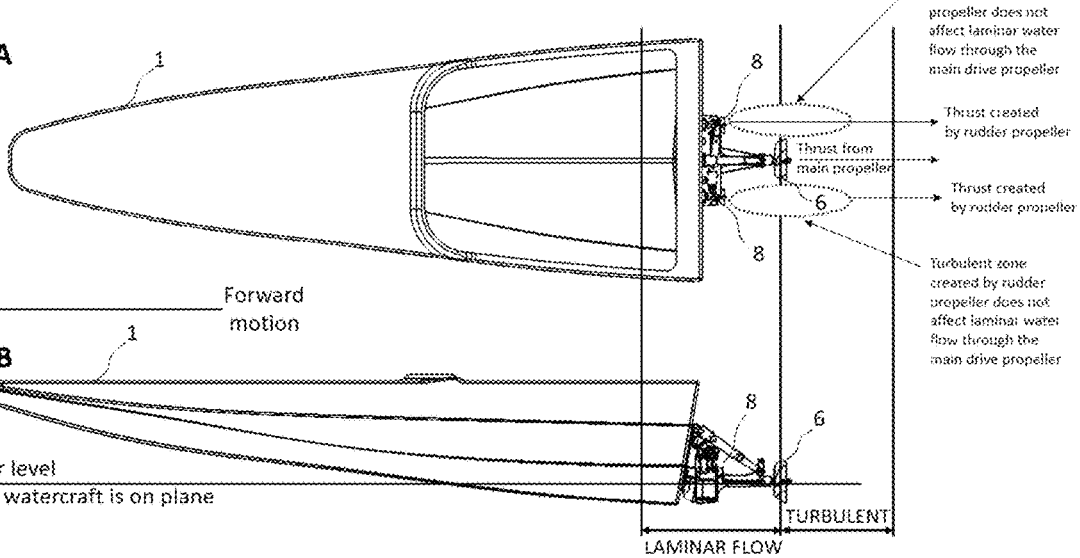
FIG. 16A is a top view of an electric propulsion system installed on a watercraft illustrating the water flow characteristics with respect to the stern thrusters and main drive propeller during forward motion.
Figure 16B:
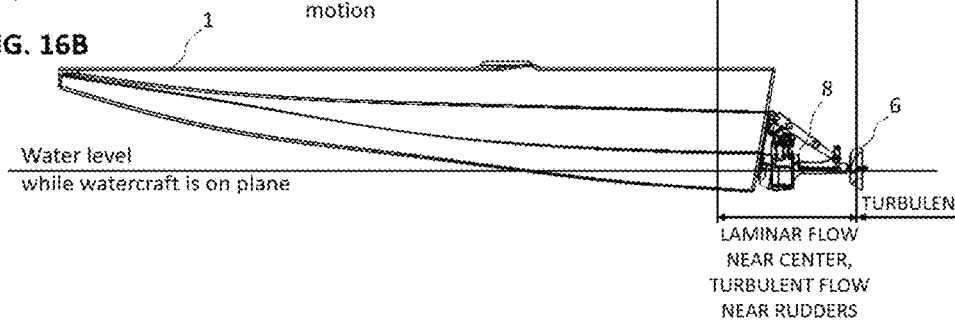
FIG. 16B is a side view of an electric propulsion system installed on a watercraft illustrating the water flow characteristics with respect to the stern thrusters and main drive propeller during forward motion.

FIGS. 16A and 16B show the water flow under the watercraft 1 during forward motion with the watercraft 1 on plane and both the rudder(s) 8 propulsion and main drive propulsion 6 powered on. The flow disturbances created by the rudder(s) 9 will not affect the thrust performance of the main drive propeller 6 since the rudder(s) are offset from the centerline of the watercraft 1 in the horizontal direction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

I claim:

1. A propulsion system for a watercraft comprising a hull extending between a stern and a bow along a longitudinal axis, and having port side and a starboard side, wherein the propulsion system comprises:

a main drive assembly comprising a main drive propeller attached to a shaft running along the longitudinal axis, and wherein the shaft is not moveable towards a port side and a starboard side of the hull, wherein the main drive assembly is movably attached to the watercraft to allow for adjustment of a vertical orientation of the main drive assembly relative to the watercraft; and a pair of rudder assemblies, wherein each of the rudder assemblies comprises:

a rudder configured for movement relative to the longitudinal axis; and an auxiliary propulsion system attached to the rudder to move in unison with the rudder relative to the longitudinal axis, and comprising an auxiliary propeller, wherein the rudders of the rudder assemblies are spaced apart from each other in a direction from the port side to the starboard side of the watercraft, and wherein the rudder assemblies are mounted to the main drive assembly so that a vertical orientation of the rudder assemblies relative to the watercraft changes as the vertical orientation of the main drive assembly relative to the watercraft is adjusted.

2. The propulsion system of claim 1, wherein the main drive assembly comprises an electric motor positioned outside the hull for rotating the shaft connected to the main drive propeller.

3. The propulsion system of claim 2, wherein no gear reduction mechanism operably couples the electric motor to the main drive propeller.

4. The propulsion system of claim 2, wherein the electric motor is disposed within a sealed housing, and the main drive assembly further comprises a cooling system for removing the heat generated within the housing by the electric motor to an exterior of the housing.

5. The propulsion system of claim 2, wherein a battery system is connected to the electric motor, the battery system comprising a plurality of battery cells distributed throughout the hull.

6. The propulsion system of claim 1, wherein the auxiliary propeller attached to the rudder is controllable independently from the main drive propeller of the main drive assembly.

7. The propulsion system of claim 1, wherein each of the rudder assemblies comprises a hydrofoil for generating lift of the hull during forward operation of the watercraft.

8. The propulsion system of claim 1, further comprising a drag-reducing cowling positioned below the main drive assembly.

9. The propulsion system of claim 1, further comprising a software-control system to allow for:

operation using the auxiliary propulsion system, without using the main drive assembly;

operation using the main drive assembly, without using the auxiliary propulsion system; and hybrid operation using the main drive assembly and the auxiliary propulsion system operating together.

10. The propulsion system of claim 1, wherein the rudders are positioned within a path of laminar flow of water conditioned by the hull.

11. The propulsion system of claim 1, wherein the rudders extend below the hull when viewed from the bow.

12. The propulsion system of claim 1, wherein the main drive propeller is not viewable when viewed from the bow.

13. The propulsion system of claim 1, wherein the main drive propeller is spaced away from the rudder assemblies such that the main drive propeller does not disturb the laminar flow of water conditioned by the hull.

14. The propulsion system of claim 1, wherein the rudders are positioned forward from the main drive propeller of the main drive assembly.

15. The propulsion system of claim 1, wherein the rudders are positioned offset from the longitudinal axis.

16. The propulsion system of claim 1, wherein the auxiliary propulsion system further comprises an electric motor for driving the auxiliary propeller.

17. The propulsion system of claim 1, further comprising a linear mechanical actuator for adjusting the vertical orientation of the main drive assembly relative to the watercraft.

18. A method of operating a watercraft comprising a hull extending between a stern and a bow along a longitudinal axis, the method comprising:

a. controlling a main drive assembly comprising a main drive motor in driving connection with a main drive propeller for providing forward thrust to the watercraft, wherein the main drive assembly is movably attached to the watercraft to allow for adjustment of a vertical orientation of the main drive assembly relative to the watercraft; and b. controlling, independently of the main drive assembly, a pair of rudder assemblies for controlling the direction of forward movement of the watercraft, wherein each of the rudder assemblies comprises:

a rudder configured for movement relative to the longitudinal axis; and an auxiliary propulsion system attached to the rudder to move in unison with the rudder relative to the longitudinal axis, and comprising an auxiliary propeller, wherein the rudders of the rudder assemblies are spaced apart from each other in a direction from the port side to the starboard side of the watercraft, and wherein the rudder assemblies are mounted to the main drive assembly so that a vertical orientation of the rudder assemblies relative to the watercraft changes as the vertical orientation of the main drive assembly relative to the watercraft is adjusted.

19. The method of claim 18, further comprising controlling a motor for rotating the auxiliary propeller independently from the main drive motor.

20. The method of claim 18, wherein each of the rudder assemblies further comprises a hydrofoil for providing a vertical lift force to the stern of the watercraft during forward operation of the watercraft.

21. The method of claim 18, wherein the rudder of each of the rudder assemblies is positioned within a laminar flow of water extending from the hull of the watercraft during forward operation of the watercraft.

22. The method of claim 18, wherein the main drive motor is configured to drive the main drive propeller positioned away from the rudders of the rudder assemblies so that the rudders do not disturb laminar flow of water to the main drive propeller.

23. The method of claim 18, wherein the method further comprises controlling a linear mechanical actuator for adjusting the vertical orientation of the main drive assembly relative to the watercraft.

* * * * *